United States Patent [19]

Cherryholmes

[11] Patent Number: 4,782,814

[45] Date of Patent: Nov. 8, 1988

[54] BURNER FOR RADIANT HEATER

[75] Inventor: John T. Cherryholmes, Potwin, Kans.

[73] Assignee: The Coleman Company, Inc., Wichita, Kans.

[21] Appl. No.: 576,037

[22] Filed: Feb. 1, 1984

[51] Int. Cl.[4] ..... F24C 3/04

[52] U.S. Cl. ..... 126/92 B; 431/329

[58] Field of Search ..... 126/92 R, 92 B, 92 AC, 126/96, 97, 93; 431/327, 328, 329, 354

[56] References Cited

U.S. PATENT DOCUMENTS

| | | | |
|---|---|---|---|
| 1,473,844 | 11/1923 | Garbarini | 126/92 B |
| 2,336,816 | 12/1943 | Thompson | 431/329 |
| 2,771,132 | 11/1956 | Du Fault | 126/92 R |
| 3,169,572 | 2/1965 | Constance et al. | 431/329 |
| 3,364,914 | 1/1968 | Bryan | 126/92 B |

FOREIGN PATENT DOCUMENTS

| | | | |
|---|---|---|---|
| 1295415 | 5/1962 | France | 126/92 R |
| 1361509 | 4/1964 | France | 431/329 |
| 898212 | 1/1982 | U.S.S.R. | 431/329 |

*Primary Examiner*—James C. Yeung

[57] ABSTRACT

A radiant heater includes a reflector and a spherical burner mounted within the reflector. The burner is formed from wire cloth, and the outer half of the burner has a finer mesh than the inner half so that fuel flows at a faster rate through the inner half. The burner is mounted on a burner tube which extends through the reflector, and a cylindrical port screen is attached to the end of the burner tube inside the burner.

14 Claims, 5 Drawing Sheets

FIG. 9
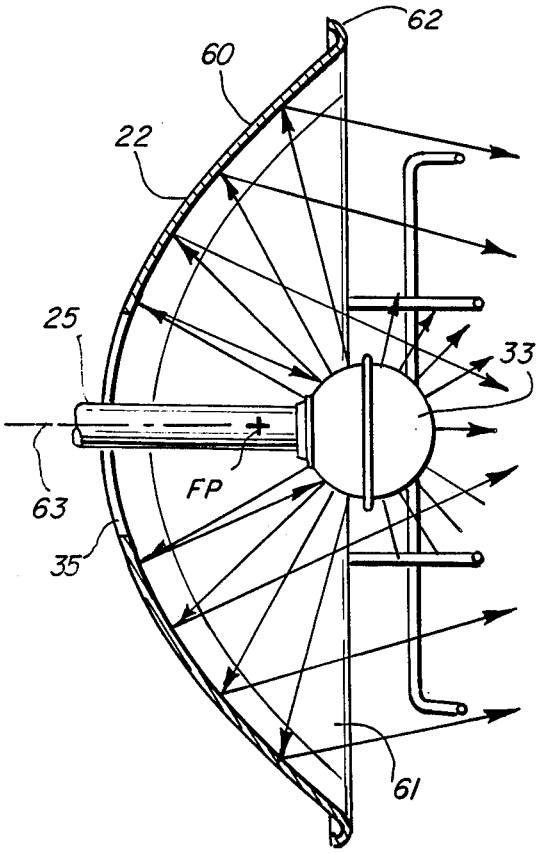
FIG. 10
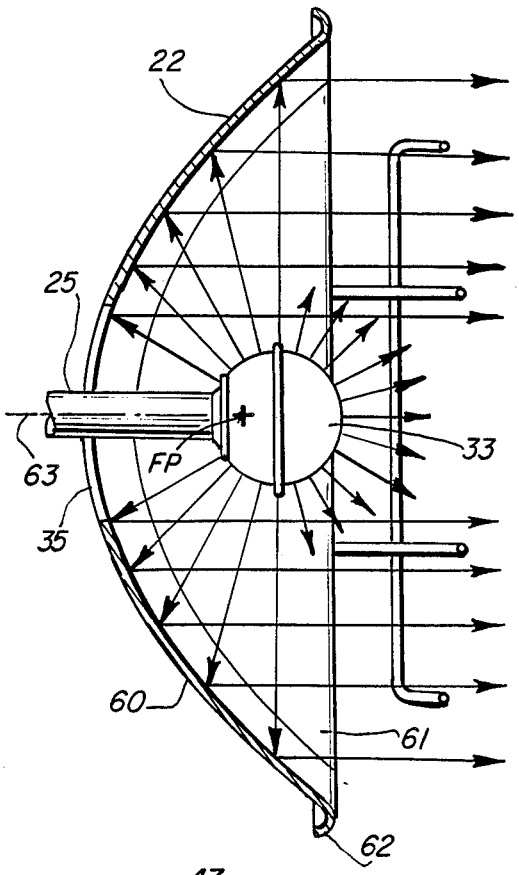
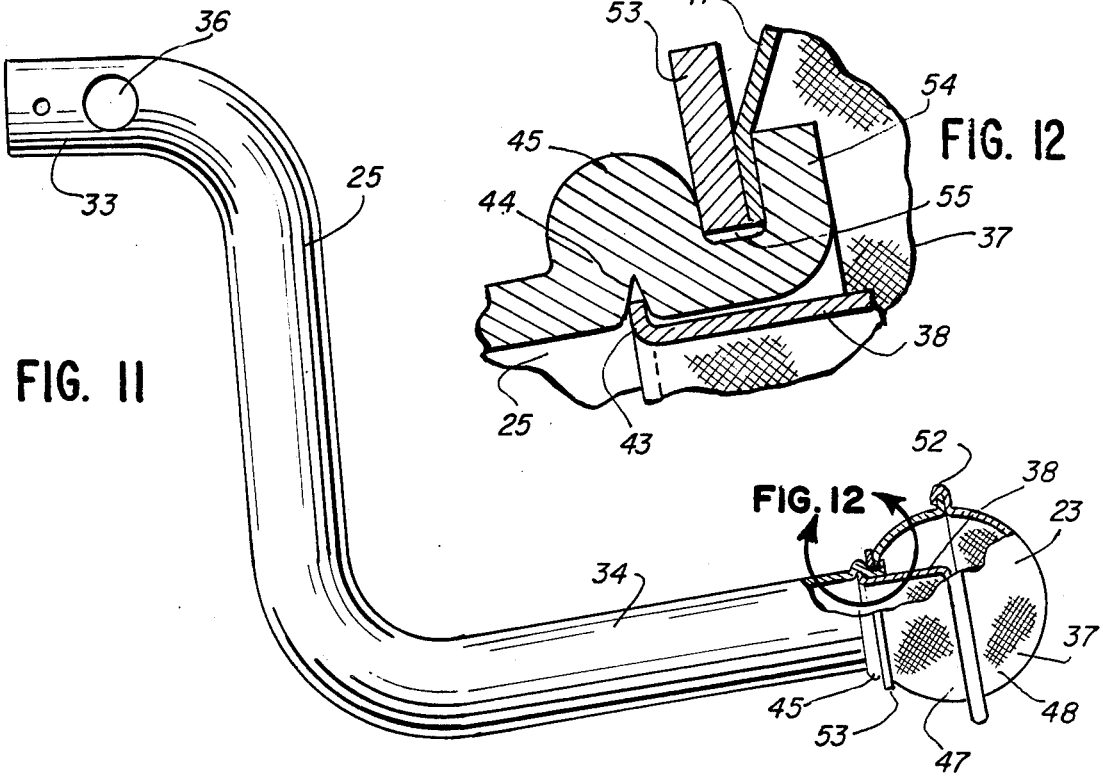
FIG. 11
FIG. 12

BURNER FOR RADIANT HEATER

BACKGROUND AND SUMMARY

This invention relates to radiant heaters, and, more particularly, to a radiant heater which includes a burner having improved radiation efficiency and reduced emissions.

Radiant heaters generally include a fuel source, such as propane or gasoline, a burner for burning the fuel and creating radiant heat energy, and a reflector for directing the radiant energy from the burner to the area which is to be heated. It is desirable that the fuel be burned as completely as possible to maximize the efficiency of the heater and to reduce the emission of unburned hydrocarbons.

The invention provides a porous burner with two different wire cloth meshes. The mesh of the outer portion of the burner away from the reflector is finer than the mesh of the inner portion of the burner. The burner is mounted on a burner tube which supplies fuel and combustion air to the burner, and a cylindrical port screen is mounted on the end of the burner tube inside the burner. The finer mesh of the outer half of the burner forces a higher percentage of the burning air/fuel mixture to flow through the inner half of the burner. The air/fuel mixture is thereby retained within the burner for a longer time, and emissions are decreased. The inner half of the burner, which is closer to the reflector, is heated to a higher temperature than the bottom half, and the radiation efficiency of the heater is increased. The cylindrical port screen slows the flow rate of the air/fuel mixture, diffuses the mixture, and decreases noise and emissions.

DESCRIPTION OF THE DRAWING

The invention will be explained in conjunction with an illustrative embodiment shown in the accompanying drawings in which

FIG. 9 is a sectional view through the reflector showing the reflecting of radiant energy when the focal point of the reflector is behind the burner;

FIG. 10 is a sectional view through the reflector showing the reflecting of radiant energy when the focal point of the reflector is at the burner;

FIG. 11 is a side elevational view of the burner assembly;

FIG. 12 is an enlarged fragmentary sectional view of a portion of FIG. 11;

DESCRIPTION OF SPECIFIC EMBODIMENT

Figure 1:
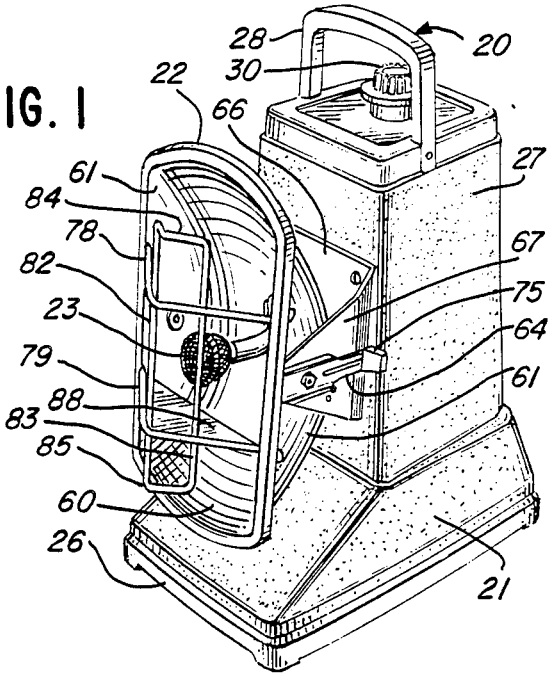
FIG. 1 is a perspective view of a radiant heater formed in accordance with the invention.
Figure 2:
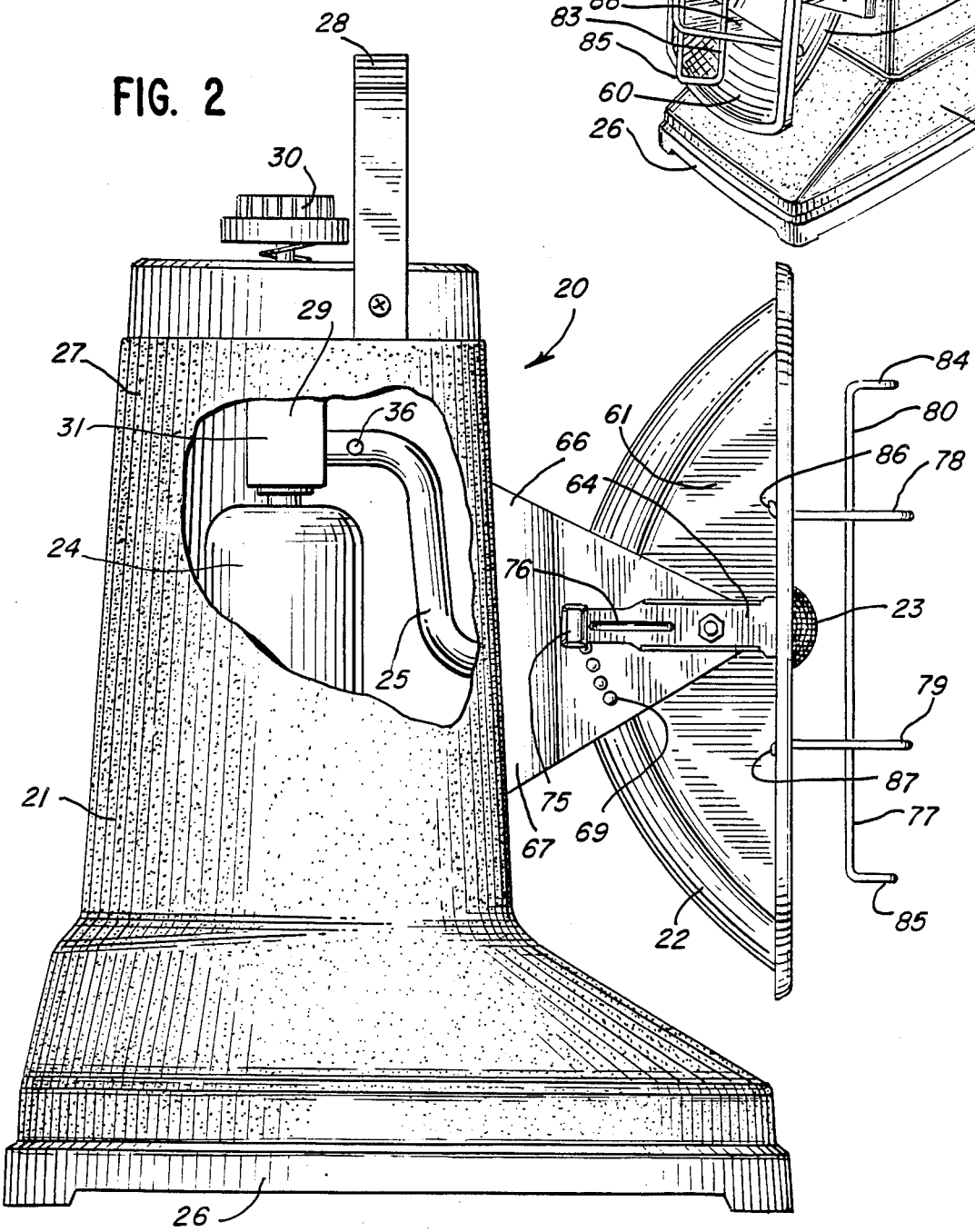
FIG. 2 is a side elevational view, partially broken away, of the heater, of FIG. 1.
Figure 3:
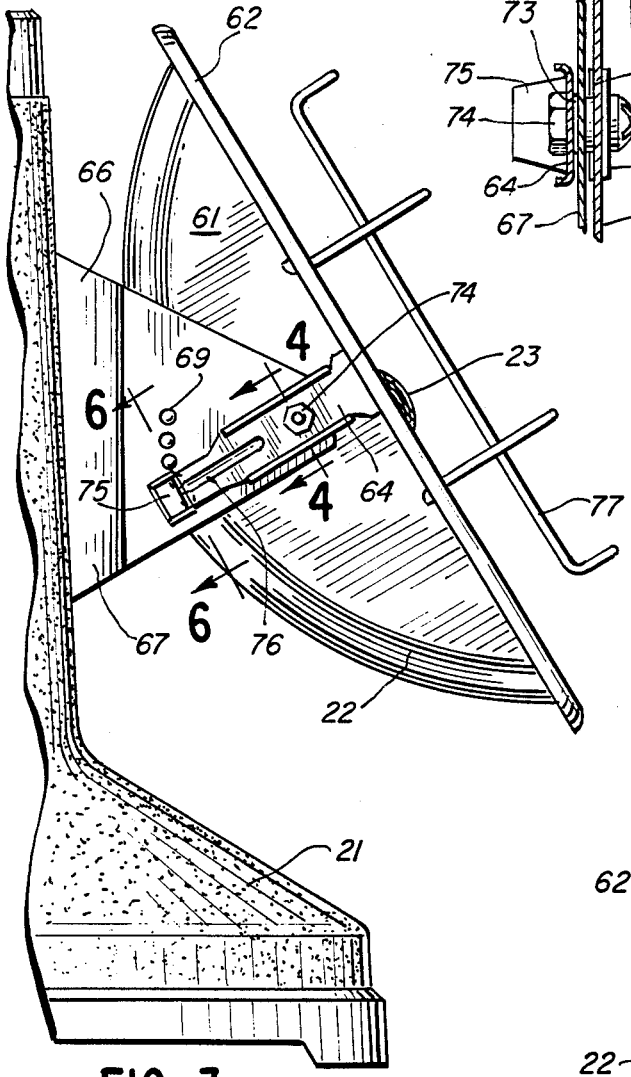
FIG. 3 is a fragmentary side elevational view showing the reflector tilted upwardly.

Referring first to FIGS. 1 and 2, a radiant heater 20 includes a base 21, a reflector 22, and a burner 23 mounted within the reflector. The particular heater illustrated is a propane burner, and a conventional propane tank 24 supplies fuel to the burner through a burner tube 25 (see also FIG. 11).

The base 21 includes an enlarged, generally rectangular bottom portion 26 and a vertically extending upper portion 27. A handle 28 is attached to the top of the base. The base is hollow and provides a chamber for the propane tank. A propane regulator 29 is mounted on the top wall of the base, and flow through the regulator is controlled by a control knob 30 on the top of the base. The regulator includes a conventional internally threaded connector portion 31 into which the threaded connection of the propane tank is screwed.

Burner Assembly

Figure 7:
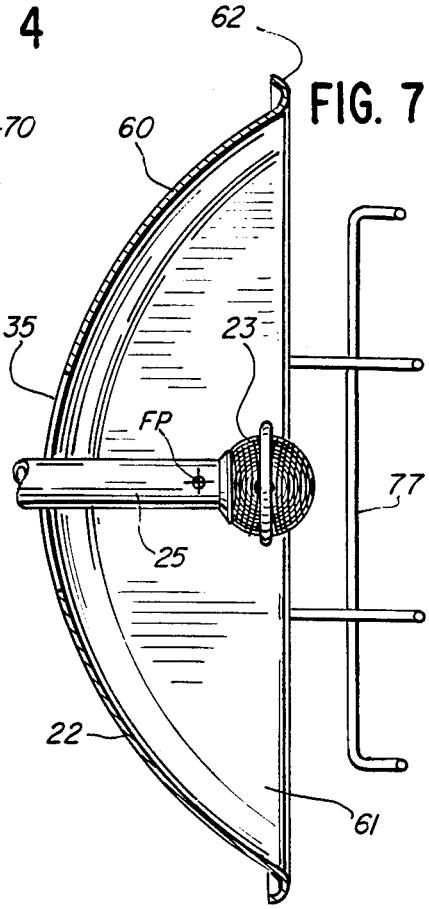
FIG. 7 is a sectional view through the reflector when the reflector is in its untilted position shown in FIG. 2.
Figure 8:
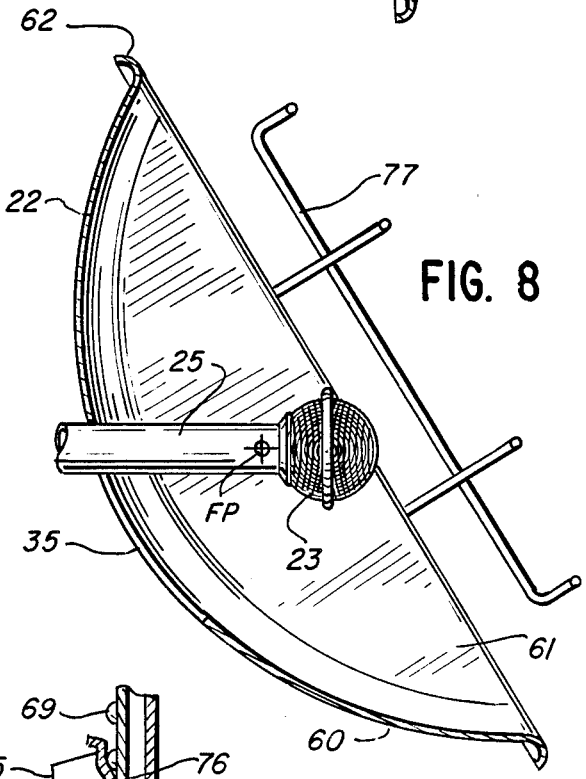
FIG. 8 is a sectional view through the reflector when the reflector is in the tilted position of FIG. 3.

Referring to FIG. 11, the burner tube 25 is generally Z-shaped and includes a first end portion 33 which is connected to the regulator 29 and a second end portion 34 which extends through a vertically elongated opening 35 in the reflector 22 (FIGS. 7 and 8). The burner tube is made of metal, and the rigidity of the tube maintains the position of the burner 23 even though the reflector is movable as will be described hereinafter. Combustion air opening 36 is provided in the burner tube adjacent the regulator 29, and combustion air is aspirated through the air opening by fuel flowing through the tube so that an air/fuel mixture is delivered to the burner.

Figure 13:
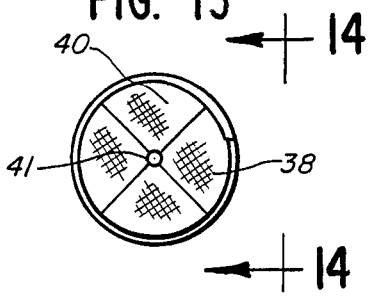
FIG. 13 is an end view of the port screen of the burner assembly.
Figure 14:
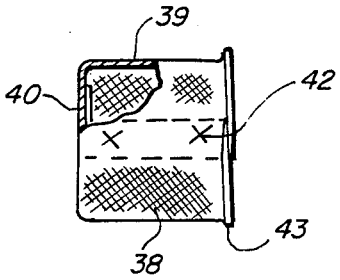
FIG. 14 is a side elevational view, partially broken away, of the port screen of FIG. 13.
Figure 15:
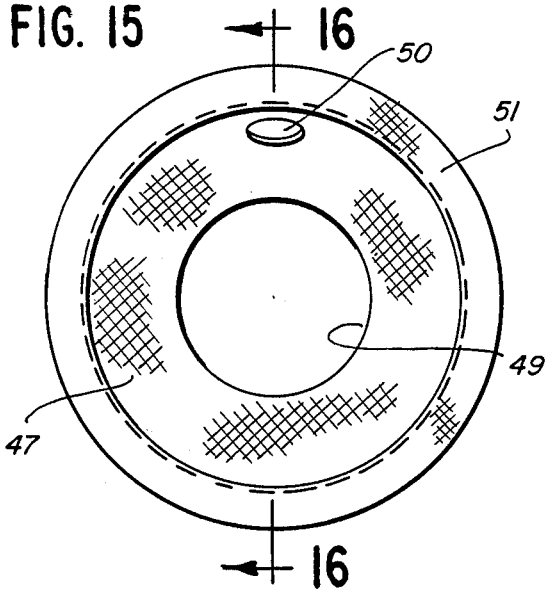
FIG. 15 is a top plan view of the inner hemisphere of the burner.
Figure 16:
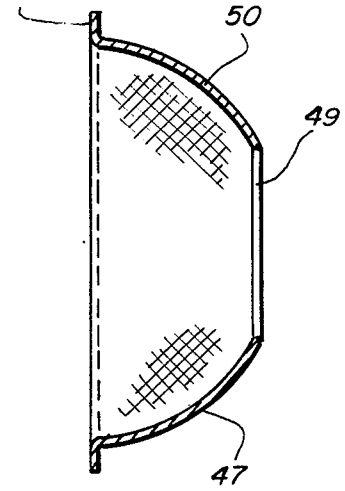
FIG. 16 is a sectional view taken along the line 16—16 of FIG. 15;.
Figure 17:
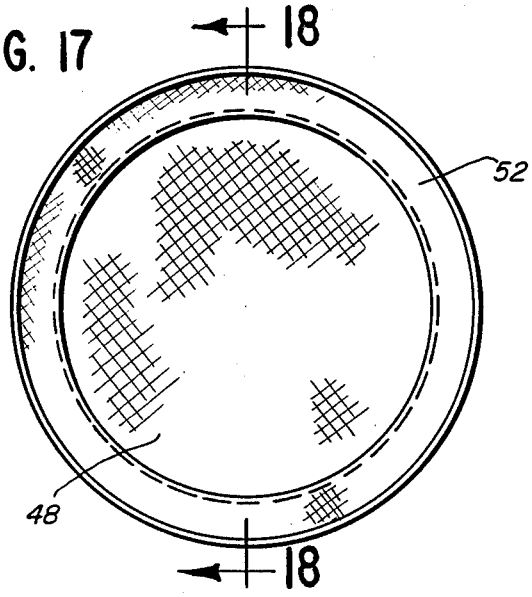
FIG. 17 is a bottom plan view of the outer hemisphere of the burner.
Figure 18:
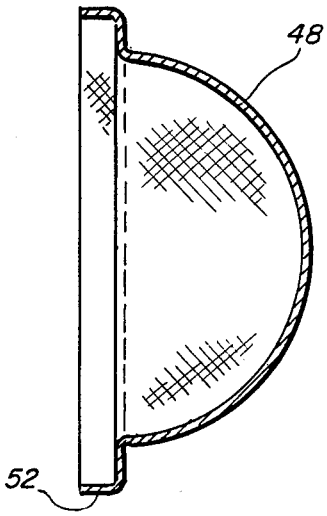
FIG. 18 is a sectional view taken along the line 18—18 of FIG. 17.
Figure 20:
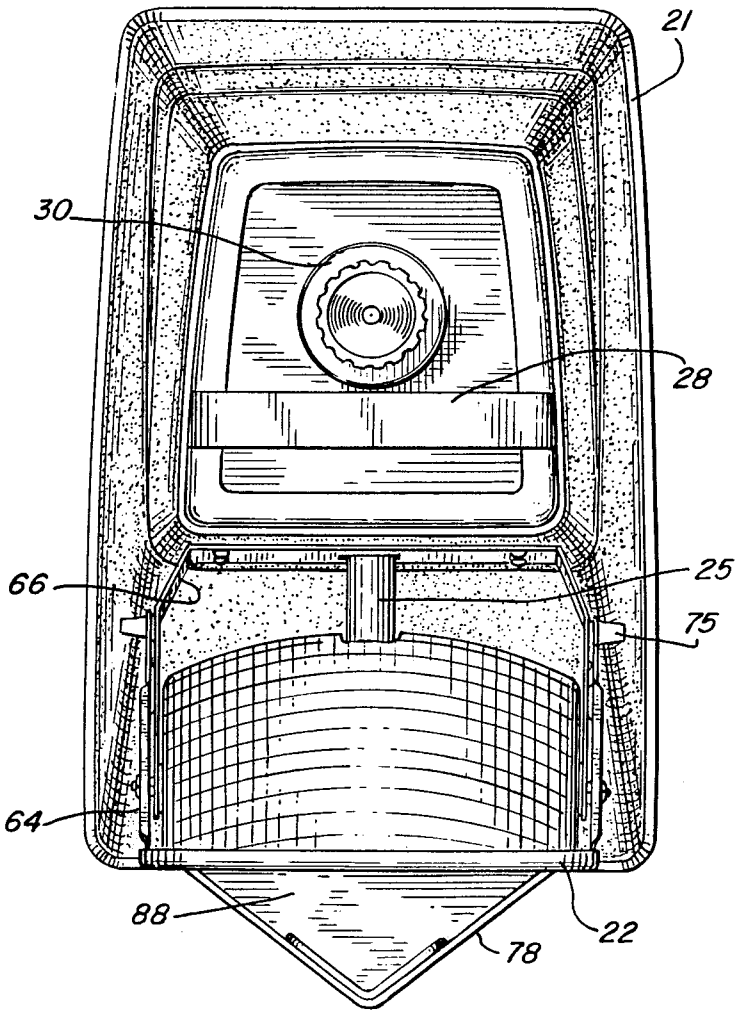
FIG. 20 is a top plan view of the heater.
Figure 19:
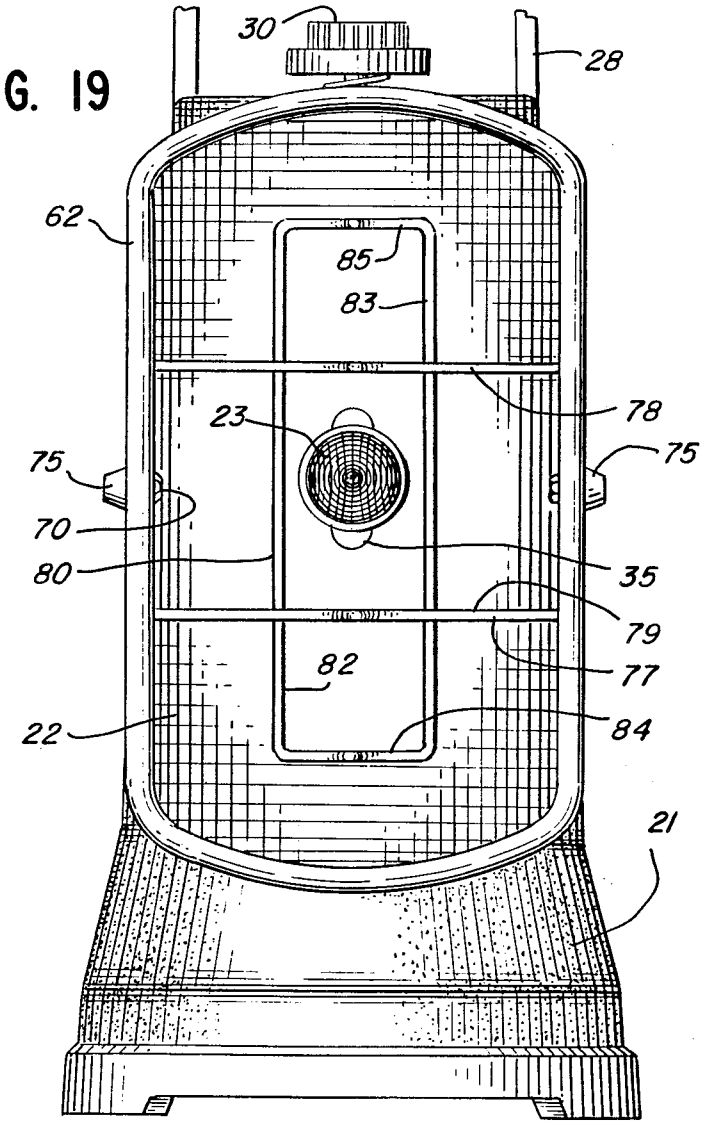
FIG. 19 is a front elevational view of the heater.

The burner head 23 includes a generally spherical burner screen 37 which is mounted on the outside of the burner tube and a generally cylindrical port screen 38 which is mounted on the inside of the burner tube. Referring to FIGS. 12–14, the port screen 38 is formed from a screen or wire cloth which is wrapped in a cylindrical shape to form a cylindrical side wall 39, and one end of the screen is folded to provide a closed end 40. A spotweld 41 on the end and two spotwelds 42 on the side secure the screen. The other end of the port screen is flared outwardly to provide an attaching flange 43.

As shown in FIG. 12, the attaching flange 43 of the port screen 38 is inserted into an annular recess 44 in the burner tube which is provided by an annular embossment or rib 45 in the tube.

Referring to FIGS. 15–18, the spherical burner screen 37 is formed from two generally hemispherically shaped screens or wire cloths 47 and 48. The inner hemisphere 47 is provided with an opening 49 through which the burner tube extends, a light opening 50, and a radially outwardly extending flange 51. The outer hemisphere 48 is intially formed with flange 52 which is L-shaped in cross section. The two hemispheres are joined by crimping the L-shaped flange 52 over the radial flange 51.

The spherical burner screen 37 is mounted on the burner tube 25 by inserting the burner tube through the opening 49 in the inner hemispherical screen 47 before the inner and outer hemispherical screens are crimped together. A washer 53 (FIG. 12) is inserted between the rib 45 and the inner screen 47, and the end of the burner tube is then flared outwardly to provide a flange 54 which secures the inner screen against the washer 53. The flange 54 and the rib 45 define an annular recess 55 in the outside of the burner tube.

The burner is ignited by opening the regulator valve and inserting a match near the light opening 50 in the inner hemisphere of the burner. After the air/fuel mixture is ignited, the flame burns substantially entirely within the spherical burner, and radiant energy is reflected by the reflector 22.

The mesh of the cylindrical port screen 38 is relatively fine and the cylindrical side wall provides considerable area so that the flow of the air/fuel mixture from the burner tube into the burner is slowed down, thereby decreasing noise. The folded end 40 of the port screen decreases the porosity of the end and further reduces the flow rate through the end. The port screen diffuses the air/fuel mixture within the spherical burner screen and assists in reducing emissions of unburned hydrocarbons from the burner. The flame does not burn inside of the cylindrical port screen, and the port screen functions like a spark arrestor.

The mesh of the outer hemispherical screen 48 is finer than the mesh of the inner hemispherical screen 47. This forces a higher percentage of the burning air/fuel mixture to exit through the inner hemisphere 47, thereby retaining the mixture within the burner screen longer, reducing emissions, and increasing the temperature of the inner hemispherical screen. Since the inner hemispherical screen is closer to the reflector 22, the radiation efficiency of the heater is improved. The diameter of the burner is sized so that the pressure of the air/fuel mixture within the burner is greater than atmospheric pressure. This not only reduces emissions but makes the burner wind-resistant.

In one specific embodiment the port screen 38 was 40 mesh, the inner hemispherical screen was 30 mesh, and the outer hemispherical screen was 40 mesh. All of the screens were Inconel wire cloth type 600 or 601 with a wire diameter of 0.010 inch. The diameter of the cylindrical port screen 38 was 0.50 inch, and the length of the cylindrical port screen was 0.68 inch. The inside radius of the hemispherical screens 47 and 48 was 0.063 inch. This provided a burner with approximately 3500 to 5000 BTU per hour, depending upon the setting of the regulator 29.

Reflector

The reflector 22 includes a curved reflecting wall 60 (FIGS. 7–10) and a pair of flat side walls 61. The outer periphery of the walls is flared rearwardly to provide a smooth curved rim 62. The elongated opening 35 for the burner tube 25 is provided in the rear end of the reflector wall. The center of the opening 35 lies along the center line 63 (FIGS. 9 and 10) of the relfector. A pair of support arms or lever arms 64 are attached to the reflector and extend rearwardly along side the side walls 61 in line with the center line of the reflector.

Figure 5:
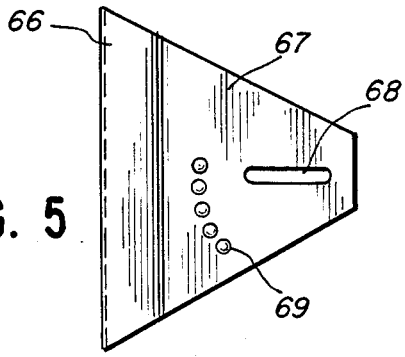
FIG. 5 is a side elevational view of the support bracket for the reflector.
Figure 6:
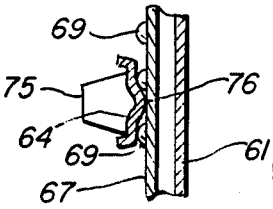
FIG. 6 is an enlarged fragmentary sectional view taken along the line 5—5 of FIG. 3.

A U-shaped support bracket 66 is mounted on the front wall of the base and includes a pair of forwardly extending parallel bracket plates 67. Referring to FIG. 5, each of the bracket plates is provided with an elongated slot 68 which extends parallel to the outer end portion 34 of the burner tube. A plurality of embossments 69 are formed in each bracket plate and the embossments extend along an arcuate path.

Figure 4:
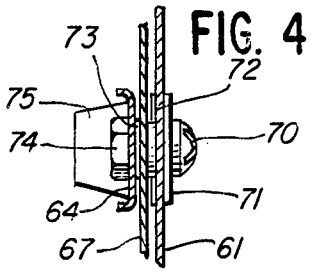
FIG. 4 is an enlarged fragmentary sectional view taken along the line 4—4 of FIG. 3.

Referring to FIG. 4, a bolt or screw 70 extends through a washer 71, a bolt hole in each of the reflector side walls 61, a washer 72, a cylindrical spacer 73, and a bolt hole in one of the lever arms 64. The cylindrical spacer 73 extends through the elongated slot 68 in the bracket plate 67, and the diameter of the spacer is just slightly less than the width of elongated slot 68. A nut 74 is screwed onto the outer end of the screw 70 and clamps the lever arm tightly against the spacer 72 so that the lever arm is fixed with respect to the reflector. The forward end of each lever arm is bent inwardly toward the reflector side wall 61, and the forward end of the lever arm is clamped against the reflector side wall by the screw.

The bolts 70 and spacers 73 support the reflector for pivoting or tilting movement, and the spacers are slidable within the slots 68 in the bracket plates to permit the curved reflecting wall 60 to be moved toward or away from the burner. The outer end of each lever arm 64 extends laterally outwardly, and a knob 75 of insulating plastic is mounted thereon. The reflector can be moved by gripping the knobs.

A rib 76 is formed in the rear portion of each of the lever arms 64 and is engageable with the embossments 69 on the bracket plate as the lever arm pivots about the bolt 70. The embossments provide detents which hold the reflector in various tilted positions.

The curved reflecting wall 60 is in the shape of a parabola and has a focal point designated F.P. in FIGS. 7–10. The focal point can be moved relative to the burner by sliding the bolts 70 along the slots 68 in the bracket plates.

In FIG. 9 the focal point is behind the burner and the radiant energy from the rear half of the burner is dispersed by the reflecting wall 60 as indicated by the arrows. In FIG. 10 the focal point is centered within the rear half of the burner, and radiant energy from the rear half of the burner is focused by the reflector wall 61 and reflected forwardly in a concentrated beam in a direction parallel to the center line of the reflector.

The forward ends of the elongated slots 68 in the bracket plates provide forward stops for the spacers 73 and the reflector. The ends of the slots are advantageously positioned so that the focal point of the reflector is centered within the rear half of the burner when the spacers abut the forward ends of the slot

Safety Guard

A safety guard 77 is mounted on the reflector to prevent objects from contacting the burner. The guard is formed from a pair of V-shaped wire rods 78 and 79 (FIGS. 1, 2, 19, and 20) which project forwardly from the side walls 61 of the reflector and a generally rectangular wire rod 80 which extends between the V-shaped rods. The rectangular rod 80 includes a pair of side portions 82 and 83 which extend parallel to the side walls 61 of the reflector and a pair of V-shaped end portions 84 and 85. The parallel rods 82 and 83 are welded to the inside of the V-shaped rods 78 and 79, and the apex of each of the V-shaped rods 84 and 85 is spaced slightly inwardly from the apex of the V-shaped rods 78 and 79.

The ends of the V-shaped rods 78 and 79 extend through holes in the side walls 61 of the reflector. The ends 86 (FIG. 2) of the rod 78 are turned upwardly, and the ends 87 of the rod 79 are turned downwardly to hold the guard on the reflector. The ends of the rods 78 and 79 can be flexed inwardly in order to insert them into the holes in the reflector, and the resilient rods will return to their initial positions after insertion in order to hold the guard on the reflector.

A triangular shield 88 (FIGS. 1 and 20) is welded to the lower V-shaped rod 79 to shield radiant energy from the surface which supports the heater.

The reflector and safety guard are lightweight, and most of the weight of the heater is provided by the propane tank. The center of gravity of the heater is therefore well behind the reflector and is substantially in line with the propane tank. If the heater is accidentally tipped over so that the safety guard contacts the supporting surface, the V-shaped safety guard will cause the heater to roll over to one side or the other. The safety guard therefore ensures that the reflector will not direct heat or radiant energy toward the supporting surface.

The dimensions of the base of the heater are such that after the safety guard causes the heater to roll over on its side, the heater will be supported by the sides of the top and bottom base and by the insulating hand knobs 75 The hot reflector will therefore be supported out of contact with the surface.

While in the foregoing specification a detailed description of a specific embodiment was set forth for the purpose of illustration, it will be understood that many of the details herein given may be varied considerably by those skilled in the art without departing from the spirit and scope of the invention.

I claim:

1. A burner assembly for a heater comprising a burner tube and a porous burner head mounted on the burner tube, the burner head being generally spherical and including a first generally hemispherical portion adjacent the burner tube and a second generally hemispherical portion remote form the burner tube, the porosity of the first portion being greater than the porosity of the second portion whereby fuel flowing through the burner tube and into the burner head will flow at a higher rate through the first portion of the burner head than through the second portion, and a generally cylindrical port screen connected to the burner tube and extending inside the burner head, the port screen including a first open end which is connected to the burner tube and a second end which is formed by overlapping portions of the screen so that the porosity of the second end is less than the porosity of the side of the port screen.

2. The burner assembly of claim 1 in which each of the first and second portions is formed from wire cloth, the mesh of the second portion being finer than the mesh of the first portion.

3. The burner assembly of claim 2 in which the wire cloth of the first portion and the wire cloth of the second portion are crimped together.

4. The burner assembly of claim 2 in which the wire cloth of the first portion is 30 mesh and the wire cloth of the second portion is 40 mesh.

5. The burner assembly of claim 2 in which the wire cloth of the first and second portions is Inconel metal.

6. The burner assembly of claim 1 in which the burner tube extends through an opening in the first portion of the burner head, the periphery of the opening in the first portion of the burner head being positioned in an annular recess in the outside of the burner tube.

7. The burner assembly of claim 6 in which the burner tube terminates in an outwardly flared end which engages the first portion of the burner head.

8. A burner assembly for a heater comprising a burner tube and a porous burner head mounted on the burner tube, the burner head being generally spherical and including a first generally hemispherical portion adjacent the burner tube and a second generally hemispherical portion remote from the burner tube, the porosity of the first portion being greater than the porosity of the second whereby fuel flowing through the burner tube and into the burner head will flow at a higher rate through the first portion of the burner head than through the second portion, the burner extending through an opening in the first portion of the burner head, the periphery of the opening in the first portion of the burner head being positioned in an annular recess in the outside of the burner tube, and a generally cylindrical port screen connected to the inside of the burner tube and extending inside the burner head, the port screen including a first open end which is positioned in an annular recess in the inside of the burner tube and a second end which is formed by overlapped portions of the screen so that the porosity of the second end is less than the porosity of the side of the port screen.

9. A burner assembly for a heater comprising a burner tube and a porous burner head mounted on the burner tube, the burner head including a first portion adjacent the burner tube and a second portion remote from the burner tube, the porosity of the first portion being greater than the porosity of the second portion whereby fuel flowing through the burner tube and into the burner head will flow at a higher rate through the first portion of the burner head through the second portion, and a generally cylindrical port screen connected to the burner tube and extending inside the burner head, the generally cylindrical port screen including a first open and which is connected to the burner tube and a second end which is formed by overlapping portions of the screen so that the porosity of the second end is less than the porosity of the side of the port screen.

10. The burner assembly of claim 9 in which the cylindrical port screen includes an outer flared end which is positioned within an annular recess in the side of the burner tube.

11. A burner assembly for a heater comprising a burner tube including a generally cylindrical port screen with a first open end connected to the burner tube and a second end which includes means to slow the axial flow of gases in comparison to the radial flow of gases and porous generally spherical burner head mounted on the burner tube, the burner head including a first position into which the burner tube extends and a second portion remote from the burner tube with each portion being generally hemispherical, the porosity of the first portion being greater than the porosity of the second portion whereby fuel flowing through the burner tube and into the burner head will flow at a higher rate through the first portion of the burner head then through the second portion.

12. A burner assembly for a heater comprising a burner tube and a porous generally spherical burner head mounted on the burner tube, the burner head including a first portion having an opening into which the burner tube extends and a second portion remote form the burner tube with each portion being generally hemispherical, the porosity of the first portion being greater than the porosity of the second portion whereby fuel flowing through the burner tube and into the burner head will flow at a higher rate through the first portion of the burner head than through the second portion, the periphery of the opening in the first portion of the burner head being positioned in an annular recess in the outside of the burner tube, and a generally cylindrical port screen connected to the inside of the burner tube and extending inside of the burner head, the port screen including a first open end which is positioned in an annular recess on the inside of the burner tube and a second end which is formed by overlapping portions of the screen so that the porosity of the second end is less than the porosity of the side of the port screen.

13. A burner assembly for a heater comprising a burner tube, a generally cylindrical port screen connected to the burner tube and a porous burner head mounted on the burner tube outside of the port screen, the burner head including a first portion into which the burner tube extends and a second portion remote from the burner tube, the porosity of the first portion being greater than the porosity of the second portion whereby fuel flowing through the burner tube and into the burner head will flow at a higher rate through the first portion of the burner head than through the second portion, the generally cylindrical port screen including a first open end which is connected to the burner tube and a second end which is formed by overlapped portions of the screen so that the porosity of the second end is less than the porosity of the side of the port screen.

14. The burner assembly of claim 13 in which the cylindrical port screen includes an outwardly flared end which is positioned within an annular recess in the inside of the burner tube.

* * * * *

UNITED STATES PATENT AND TRADEMARK OFFICE

CERTIFICATE OF CORRECTION

PATENT NO. : 4,782,814

DATED : November 8, 1988

INVENTOR(S) : John T. Cherryholmes

It is certified that error appears in the above-identified patent and that said Letters Patent is hereby corrected as shown below:

Col. 6, line 14 insert --portion-- before "whereby".
Col. 6, line 37 insert --than-- before "through".
Col. 6, line 41 change the first occurrence of "and" to --end--.
Col. 6, line 47 change "side" to --inside--.
Col. 6, line 54 insert --a-- before "porous".
Col. 6, line 56 change "position" to --portion--.
Col. 6, line 68 change "form" to --from--.

Signed and Sealed this

Seventh Day of March, 1989

*Attest:*

DONALD J. QUIGG

*Attesting Officer*

*Commissioner of Patents and Trademarks*